US007849841B2

(12) United States Patent
Holzmann et al.

(10) Patent No.: US 7,849,841 B2
(45) Date of Patent: Dec. 14, 2010

(54) CRANKCASE VENTILATION SYSTEM WITH ENGINE DRIVEN PUMPED SCAVENGED OIL

(75) Inventors: Mark V. Holzmann, Stoughton, WI (US); Ryan W. Rutzinski, Waukesha, WI (US); Michael J. Conner, Stoughton, WI (US); Christopher E. Holm, Madison, WI (US); Bradley T. Clark, Janesville, WI (US)

(73) Assignee: Cummins Filtration IP, Inc., Minneapolis, MN (US)

( * ) Notice: Subject to any disclaimer, the term of this patent is extended or adjusted under 35 U.S.C. 154(b) by 141 days.

(21) Appl. No.: 12/340,924

(22) Filed: Dec. 22, 2008

(65) Prior Publication Data

US 2010/0043734 A1 Feb. 25, 2010

Related U.S. Application Data

(63) Continuation-in-part of application No. 11/828,613, filed on Jul. 26, 2007, now Pat. No. 7,699,029.

(51) Int. Cl.
*F01M 13/04* (2006.01)

(52) U.S. Cl. ..... 123/572; 123/41.86

(58) Field of Classification Search ..... 123/572–574, 123/41.86, 196 W
See application file for complete search history.

(56) References Cited

U.S. PATENT DOCUMENTS 2,688,316 A * 9/1954 Brill ..... 123/41.86
3,769,879 A 11/1973 Lofquist, Jr.
3,824,973 A 7/1974 Harhaus
4,093,403 A 6/1978 Schrimpf et al.
4,406,591 A 9/1983 Louis
4,452,195 A * 6/1984 Matsumoto et al. ... 123/195 AC
4,557,226 A 12/1985 Mayer et al.
5,315,968 A 5/1994 Niebrzydoski
5,479,907 A * 1/1996 Walker, Jr. ..... 123/573
5,893,343 A 4/1999 Rigazzi
6,092,492 A * 7/2000 Kampichler et al. ..... 123/41.86
6,247,463 B1 6/2001 Fedorowicz et al.
6,279,555 B1 8/2001 Crowell et al.
6,279,556 B1 8/2001 Busen et al.
6,290,738 B1 9/2001 Holm
6,354,283 B1 3/2002 Hawkins et al.

(Continued)

FOREIGN PATENT DOCUMENTS

EP 1 275 828 1/2003

OTHER PUBLICATIONS

"The Design of Jet Pumps", Gustav Flugel, National Advisory Committee for Aeronautics, Technical Memorandum No. 982, 1939.

(Continued)

*Primary Examiner*—M. McMahon
(74) *Attorney, Agent, or Firm*—Andrus, Sceales, Starke & Sawall, LLC; J. Bruce Schelkopf

(57) ABSTRACT

A crankcase ventilation system for an internal combustion engine has an engine driven pump pumping scavenged separated oil from the oil outlet of an air-oil separator to the crankcase, preferably using engine generated pulsating oscillatory positive and negative relative pressure pulses.

5 Claims, 12 Drawing Sheets

U.S. PATENT DOCUMENTS

| | | | | |
|---|---|---|---|---|
| 6,478,019 | B2 | 11/2002 | Fedorowicz et al. | |
| 6,505,615 | B2 | 1/2003 | Pietschner | |
| 6,626,163 | B1 | 9/2003 | Busen et al. | |
| 6,684,864 | B1 | 2/2004 | Busen et al. | |
| 7,238,216 | B2 | 7/2007 | Malgorn et al. | |
| 7,406,960 | B2 | 8/2008 | Knauf et al. | |
| 7,473,291 | B2 | 1/2009 | Evenstad et al. | |
| 7,699,029 | B2 * | 4/2010 | Herman et al. | 123/41.86 |
| 2003/0101960 | A1 | 6/2003 | Tsuchiya et al. | |
| 2004/0263558 | A1 * | 12/2004 | Seshimo | 347/30 |
| 2006/0086649 | A1 | 4/2006 | Wieczorek et al. | |
| 2007/0119515 | A1 * | 5/2007 | Phillips et al. | 141/65 |
| 2007/0256566 | A1 | 11/2007 | Faber et al. | |
| 2008/0264018 | A1 | 10/2008 | Herman | |
| 2010/0175642 | A1 * | 7/2010 | Herman et al. | 123/41.86 |

OTHER PUBLICATIONS

"Jet-Pump Theory and Performance with Fluids of High Viscosity", R.G. Cunningham, Transactions of the ASME, Nov. 1957, pp. 1807-1820.

* cited by examiner

CRANKCASE VENTILATION SYSTEM WITH ENGINE DRIVEN PUMPED SCAVENGED OIL

CROSS-REFERENCE TO RELATED APPLICATION

This application is a continuation-in-part of U.S. patent application Ser. No. 11/828,613, filed Jul. 26, 2007, incorporated herein by reference now U.S. Pat. No. 7,699,029.

BACKGROUND AND SUMMARY

The invention relates to crankcase ventilation systems for internal combustion engines.

Crankcase ventilation systems for internal combustion engines are known in the prior art. An internal combustion engine generates blowby gas in a crankcase containing engine oil and oil aerosol. An air/oil separator has an inlet receiving blowby gas and oil aerosol from the crankcase, and an air outlet discharging clean blowby gas to the atmosphere or back to the engine air intake, and an oil outlet discharging scavenged separated oil back to the crankcase. The separator has a pressure drop thereacross such that the pressure at its inlet and in the crankcase is higher than the pressure at the separator air outlet and oil outlet. The pressure differential between the crankcase and the oil outlet of the separator normally tends to cause backflow of oil from the higher pressure crankcase to the lower pressure oil outlet. It is known in the prior art to locate the oil outlet of the separator at a given vertical elevation above the crankcase and to provide a vertical connection tube therebetween with a check valve to in turn provide a gravity head overcoming the noted pressure differential and backflow tendency, in order that oil can drain from the separator to the crankcase.

The invention of the noted parent '613 application provides another solution to the above noted problem in a simple and effective manner.

The present invention provides a further solution to the noted problem in a simple and effective manner.

BRIEF DESCRIPTION OF THE DRAWINGS

Parent Application

FIG. 1 is a schematic illustration of a crankcase ventilation system for an internal combustion engine in accordance with the parent invention.

FIG. 2 is fluid flow diagram illustrating operation of a component of FIG. 1.

FIG. 3 is like FIG. 1 and shows another embodiment.

FIG. 4 is like FIG. 1 and shows another embodiment.

FIG. 5 is like FIG. 1 and shows another embodiment.

FIG. 6 is an enlarged partial sectional view of a portion of FIG. 1 and showing a further embodiment.

FIG. 7 is an enlarged partial sectional view of a portion of FIG. 1 and showing a further embodiment.

Present Application

Figure 8:
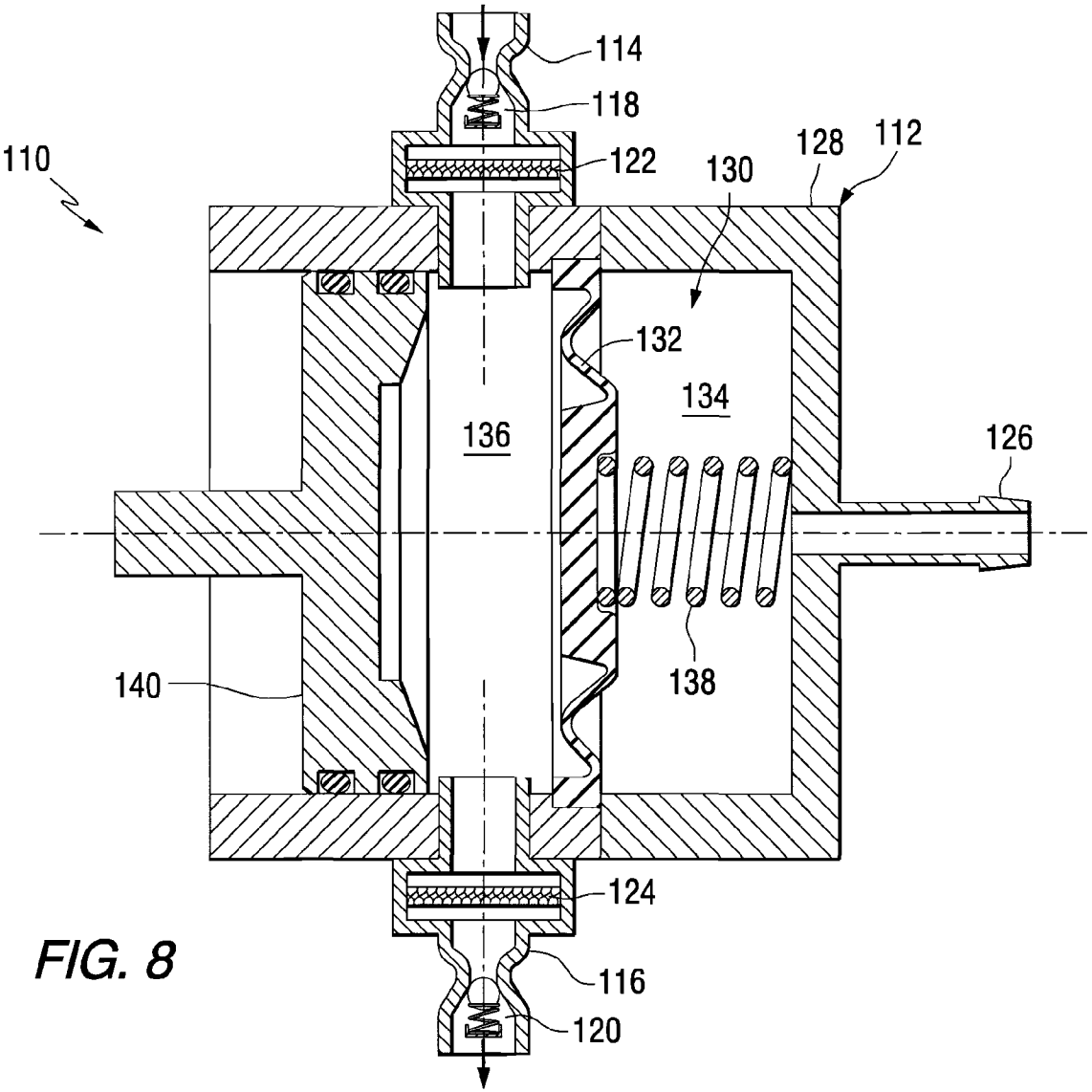

FIG. 8 is a schematic illustration of a crankcase ventilation system for an internal combustion engine in accordance with the invention.

Figure 9:
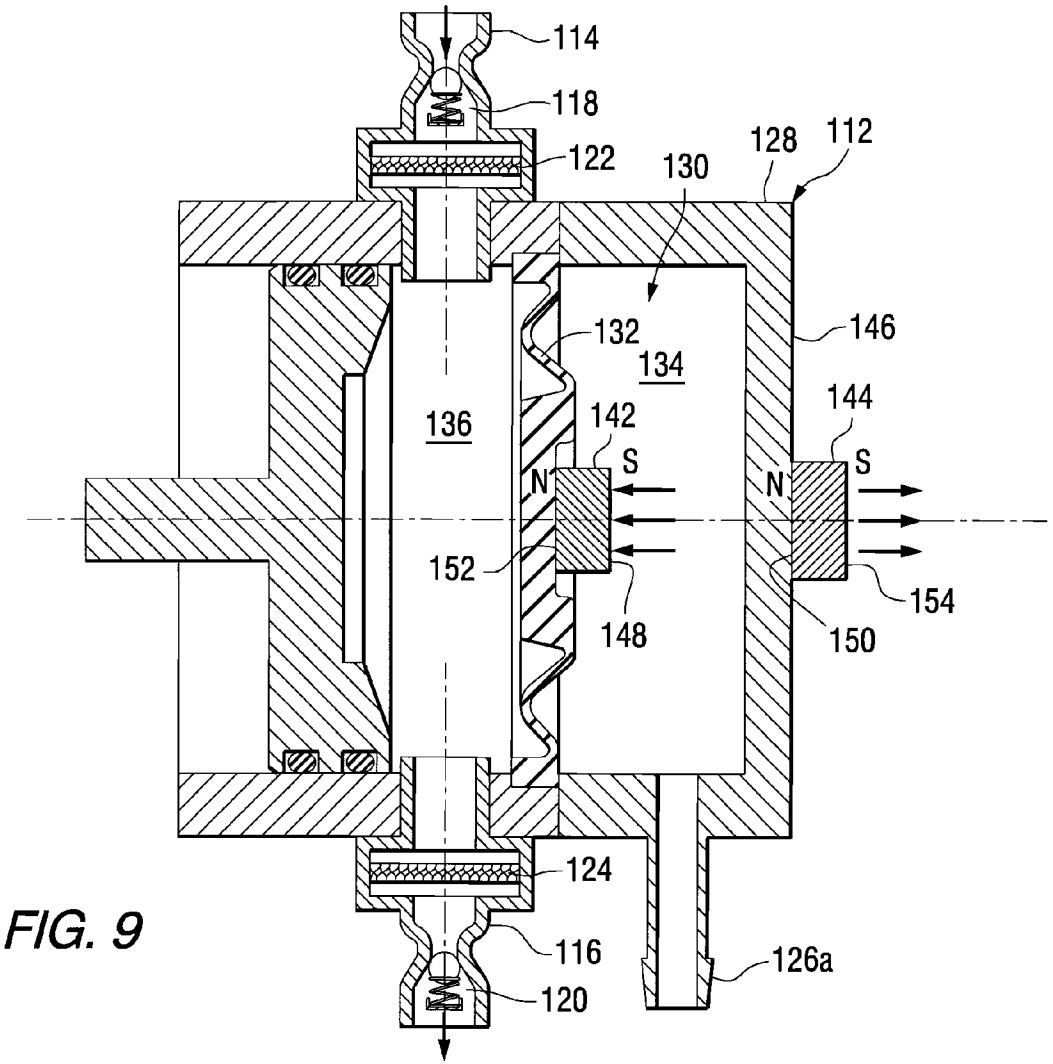

FIG. 9 is like FIG. 8 and shows another embodiment.

Figure 10:
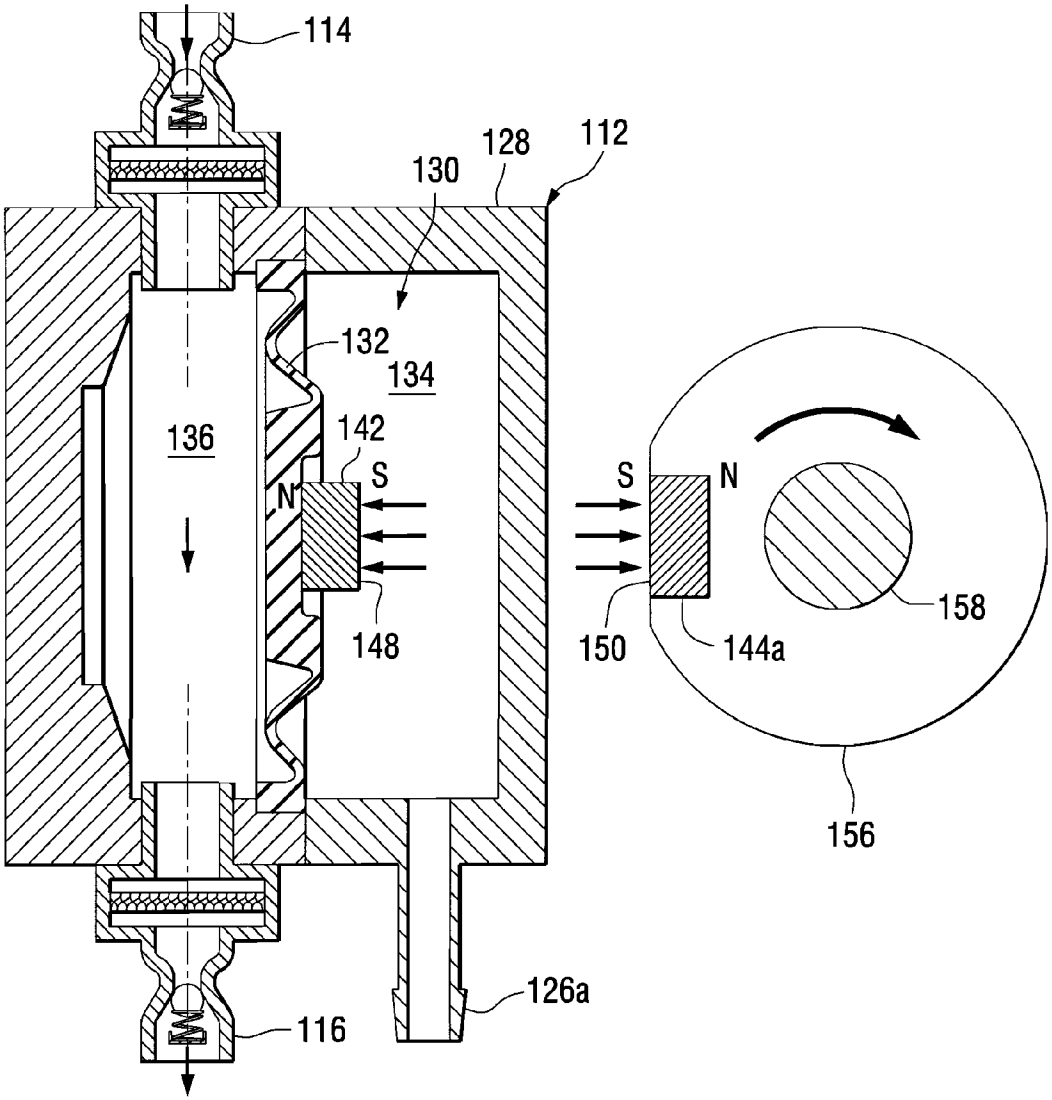

FIG. 10 is like FIG. 8 and shows another embodiment.

Figure 11:
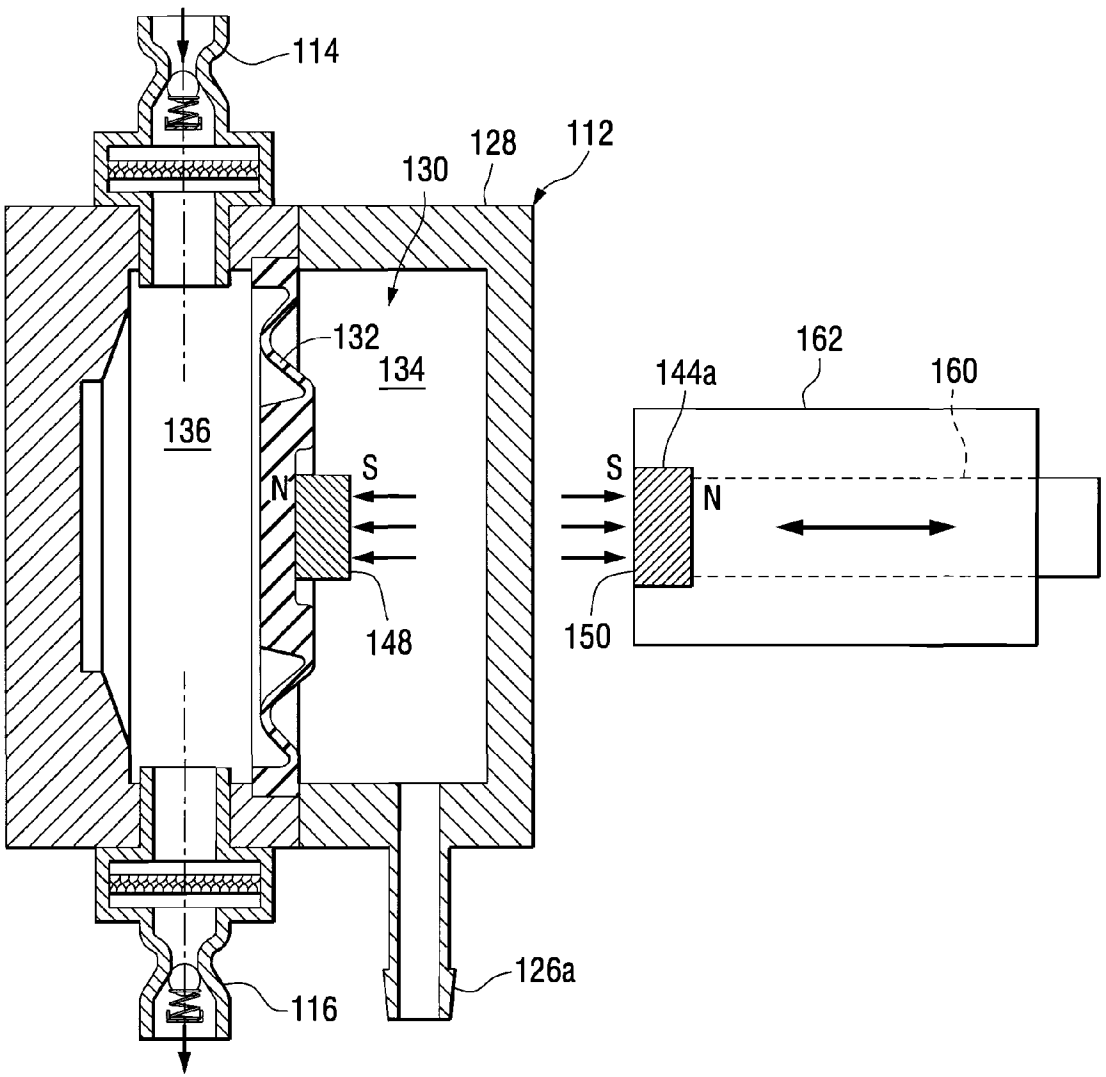

FIG. 11 is like FIG. 8 and shows another embodiment.

Figure 12:
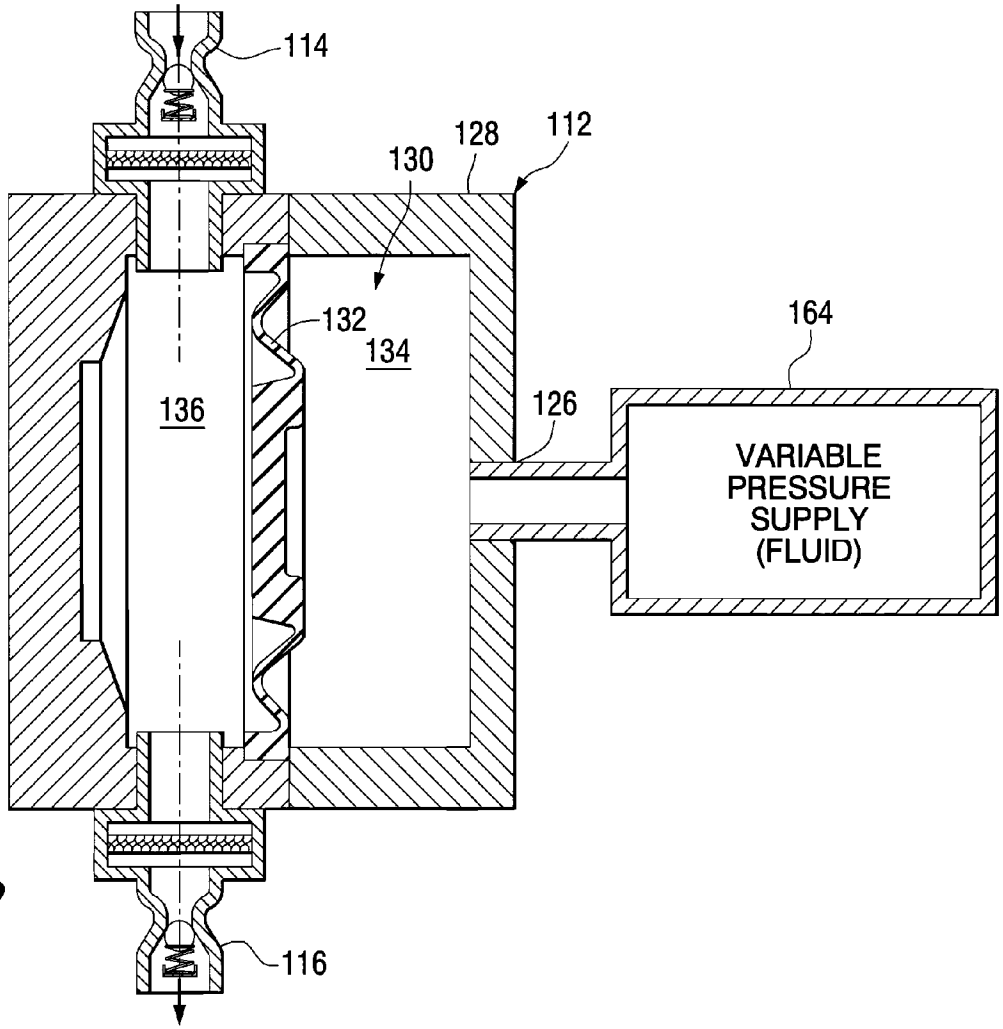

FIG. 12 is like FIG. 8 and shows another embodiment.

DETAILED DESCRIPTION

Parent Application

The following description of FIGS. 1-7 is taken from the noted parent '613 application.

Figure 1:
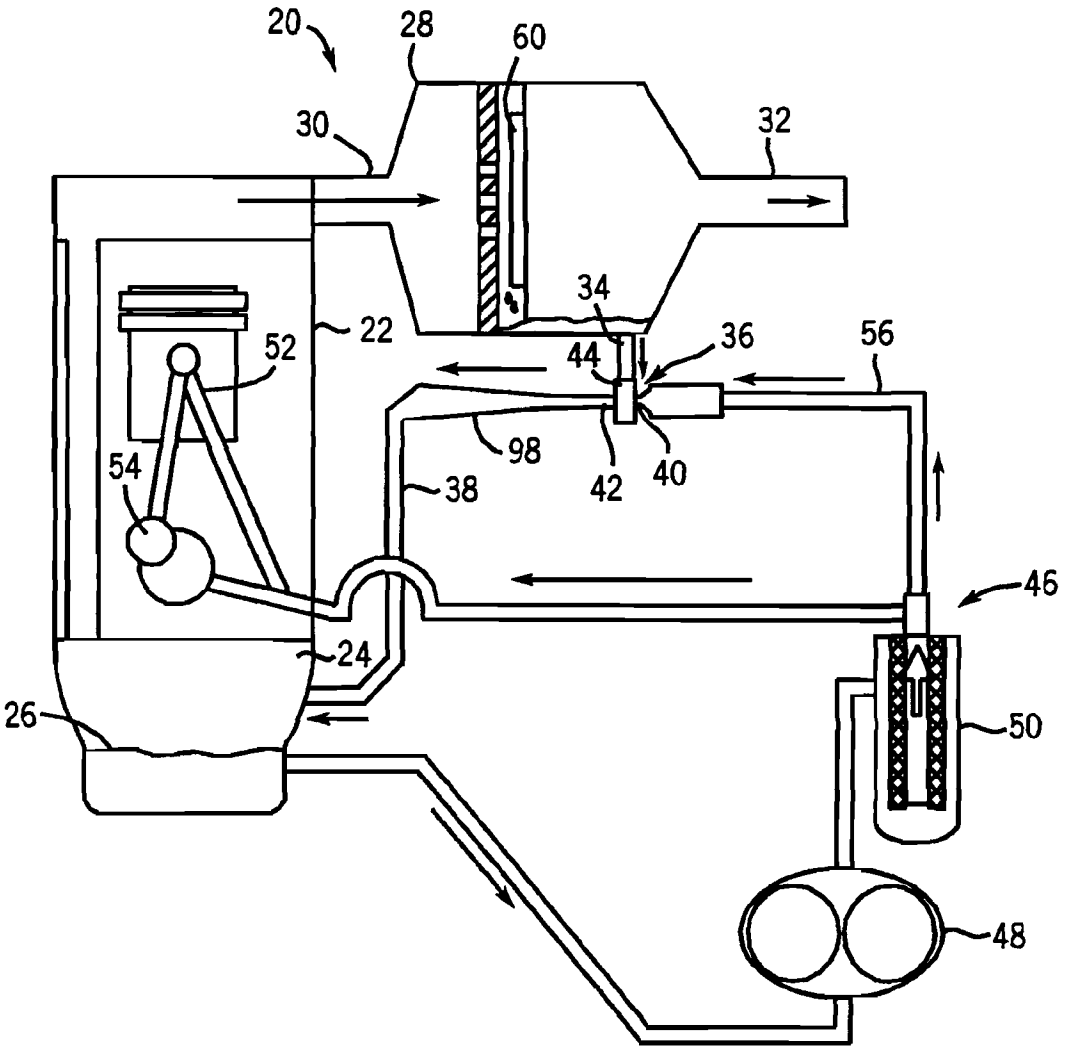
FIGS. 1-7 are taken from the noted parent '613 application.
Figure 2:
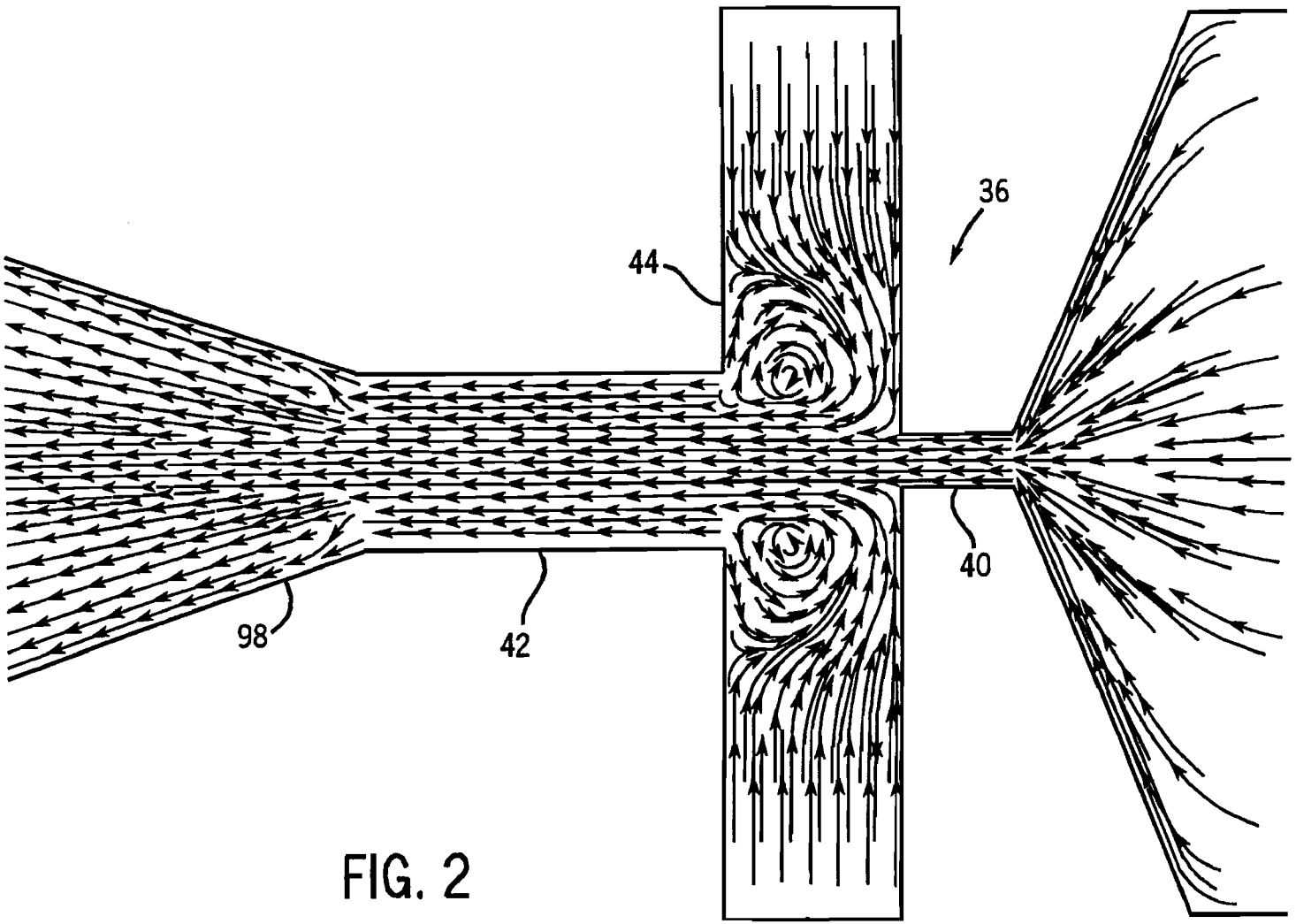

FIG. 1 shows a crankcase ventilation system 20 for an internal combustion engine 22 generating blowby gas in a crankcase 24 containing engine oil 26 and oil aerosol. The system includes an air/oil separator 28 having an inlet 30 receiving blowby gas and oil aerosol from the crankcase, and having an air outlet 32 discharging clean blowby gas to the atmosphere or returned to the engine air intake, and having an oil outlet 34 discharging scavenged separated oil back to the crankcase, all as is known. In one embodiment air/oil separator 28 is an inertial impactor, for example as in the following incorporated U.S. Pat. Nos. 6,247,463; 6,290,738; 6,354,283; 6,478,109. The system further includes a jet pump 36 pumping scavenged separated oil from oil outlet 34 to crankcase 24. Jet pumps are known in the prior art, for example: "The Design of Jet Pumps", Gustav Flugel, National Advisory Committee for Aeronautics, Technical Memorandum No. 982, 1939; "Jet-Pump Theory and Performance with Fluids of High Viscosity", R. G. Cunningham, Transactions of the ASME, November 1957, pages 1807-1820. Separator 28 has a pressure drop thereacross such that the pressure at inlet 30 and in crankcase 24 is higher than the pressure at air outlet 32 and at oil outlet 34. The pressure differential between crankcase 24 and oil outlet 34 normally tends to cause backflow of oil from the higher pressure crankcase 24 to the lower pressure oil outlet 34. In the prior art, oil outlet 34 is located at a given elevation above crankcase 24 (typically greater than about 15 inches, though the dimensions vary) and a vertical connection tube is provided therebetween with a check valve, such that a gravity head develops and can overcome the noted pressure differential. In contrast, jet pump 36 in the parent system supplies pumping pressure greater than the noted pressure differential to overcome the noted backflow tendency and instead cause suctioning of scavenged separated oil from oil outlet 34 and pumping of same to crankcase 24 via connection conduit 38. As is known, a jet pump is operated by a motive fluid directed through a reduced diameter jet nozzle 40 into a larger diametered mixing bore 42 having a suction chamber 44 therearound. The momentum exchange between the high velocity motive jet flow from motive jet nozzle 40 and the lower velocity surrounding fluid in mixing bore 42 creates the pumping effect which suctions and pumps fluid from chamber 44, for example as shown in the flow diagram in FIG. 2. In FIG. 1, jet pump 36 is a fluid-driven jet pump having a pressurized drive input at 40 receiving pressurized motive fluid from a source of pressurized fluid, a suction input at 44 receiving separated oil from oil outlet 34 of separator 28, and an output at 42 delivering jet-pumped oil to crankcase 24 via conduit 38.

The engine includes an oil circulation system 46 circulating engine oil 26 from crankcase 24 through an oil pump 48 delivering pressurized oil through filter 50 to selected engine components such as piston 52 and crankshaft 54 and then back to crankcase 24. In the embodiment of FIG. 1, jet pump 36 is an oil-driven jet pump having a pressurized drive input via conduit 56 receiving pressurized motive oil from oil pump 48, a suction input at 44 receiving separated oil from oil outlet 34 of separator 28, and an output at 42 delivering jet-pumped oil via conduit 38 to crankcase 24.

Figure 3:
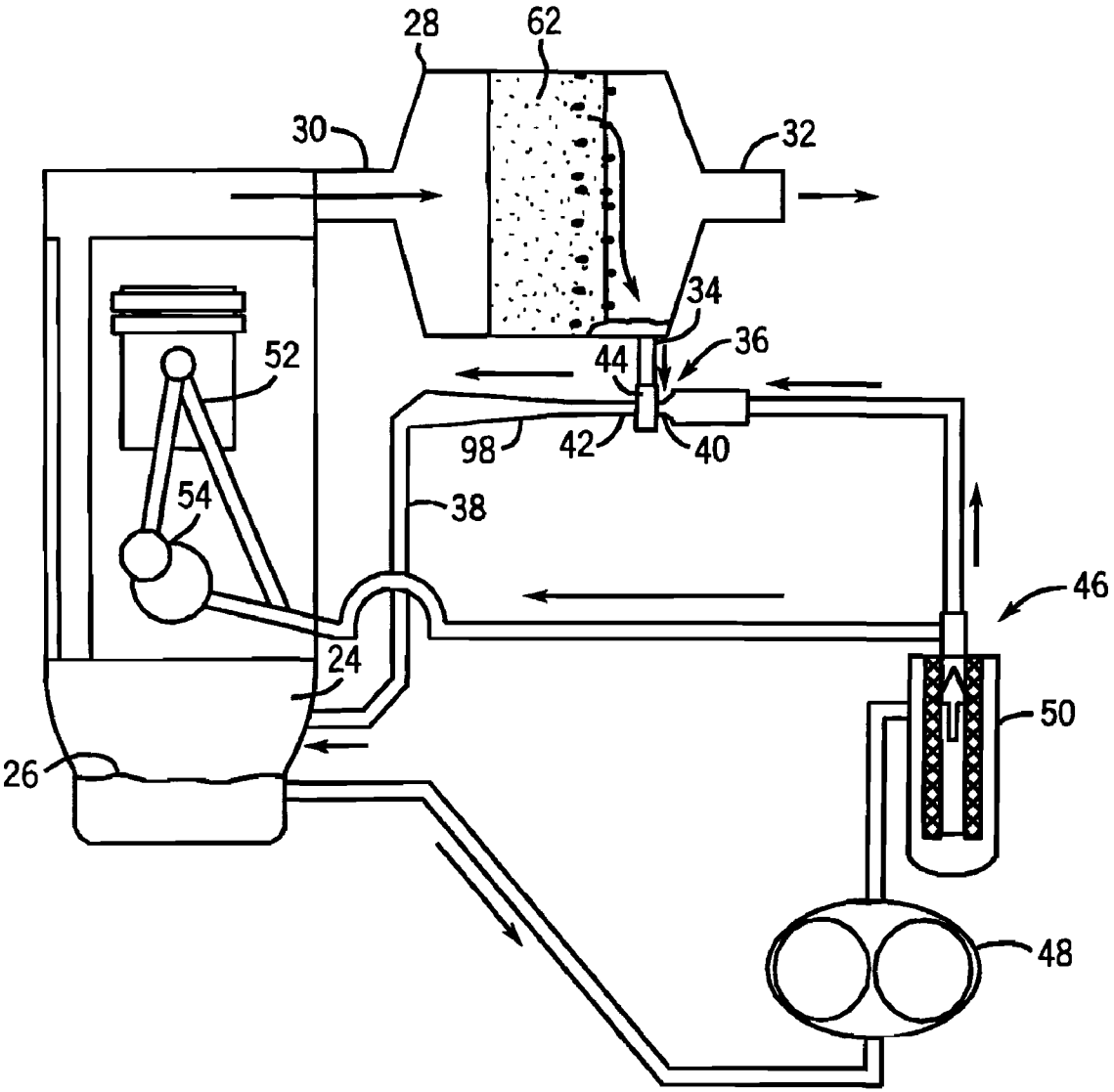
Figure 4:
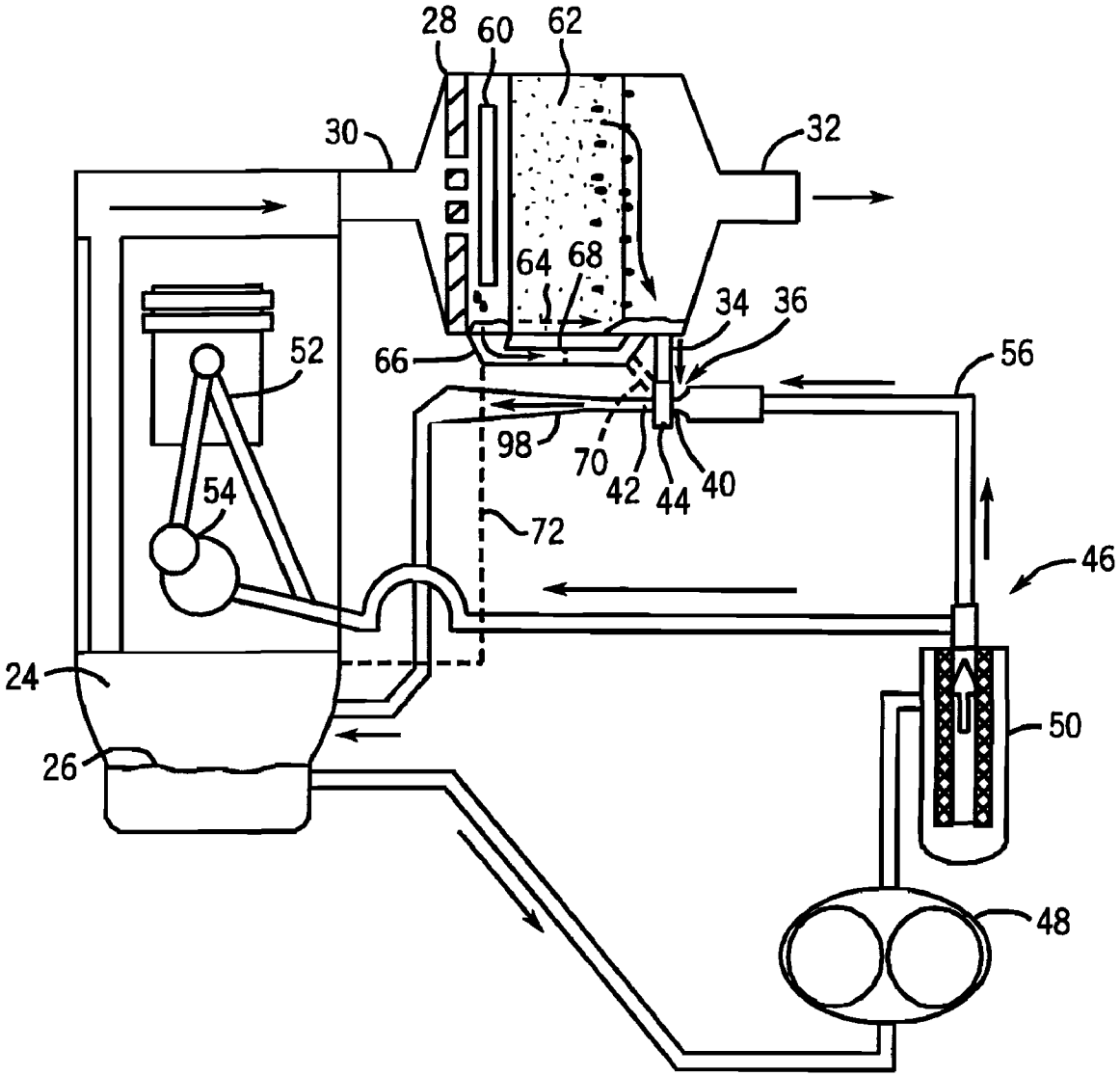

FIGS. 3 and 4 show further embodiments and use like reference numerals from above where appropriate to facilitate understanding. In FIG. 1, separator 28 includes an inertial impactor 60, as noted above. In FIG. 3, separator 28 includes a coalescer 62, for example as shown in the above noted incorporated patents. In FIG. 4, separator 28 includes both inertial impactor 60 and coalescer 62, for example as shown in the above noted incorporated patents. In FIG. 4, inertial impactor 62 is upstream of coalescer 60. Separated oil from coalescer 62 drains to oil outlet 34 of the separator. In one embodiment, separated oil from impactor 60 drains through coalescer 62 as shown in dashed line at 64 and then to oil outlet 34 of the separator. In another embodiment, separator 28 has an auxiliary drain channel 66 draining separated oil from impactor 60 to oil outlet 34 of the separator and bypassing coalescer 62. Auxiliary drain channel 66 has a flow-limiting bleed orifice 68 therein. In another embodiment, separator 28 has a second oil outlet at 66 draining separated oil from impactor 60 to suction input 44 of the jet pump as shown in dashed line at 70. In another embodiment, separator 28 has a second oil outlet at 66 draining separated oil from impactor 60 back to crankcase 24 as shown in dashed line at 72, which may require a gravity head, as above noted, which separated oil from impactor 60 drains through second outlet 66 and passage 72 to crankcase 24 by gravity, without passage through jet pump 36 pumping separated oil from first oil outlet 34 of separator 28.

Figure 5:
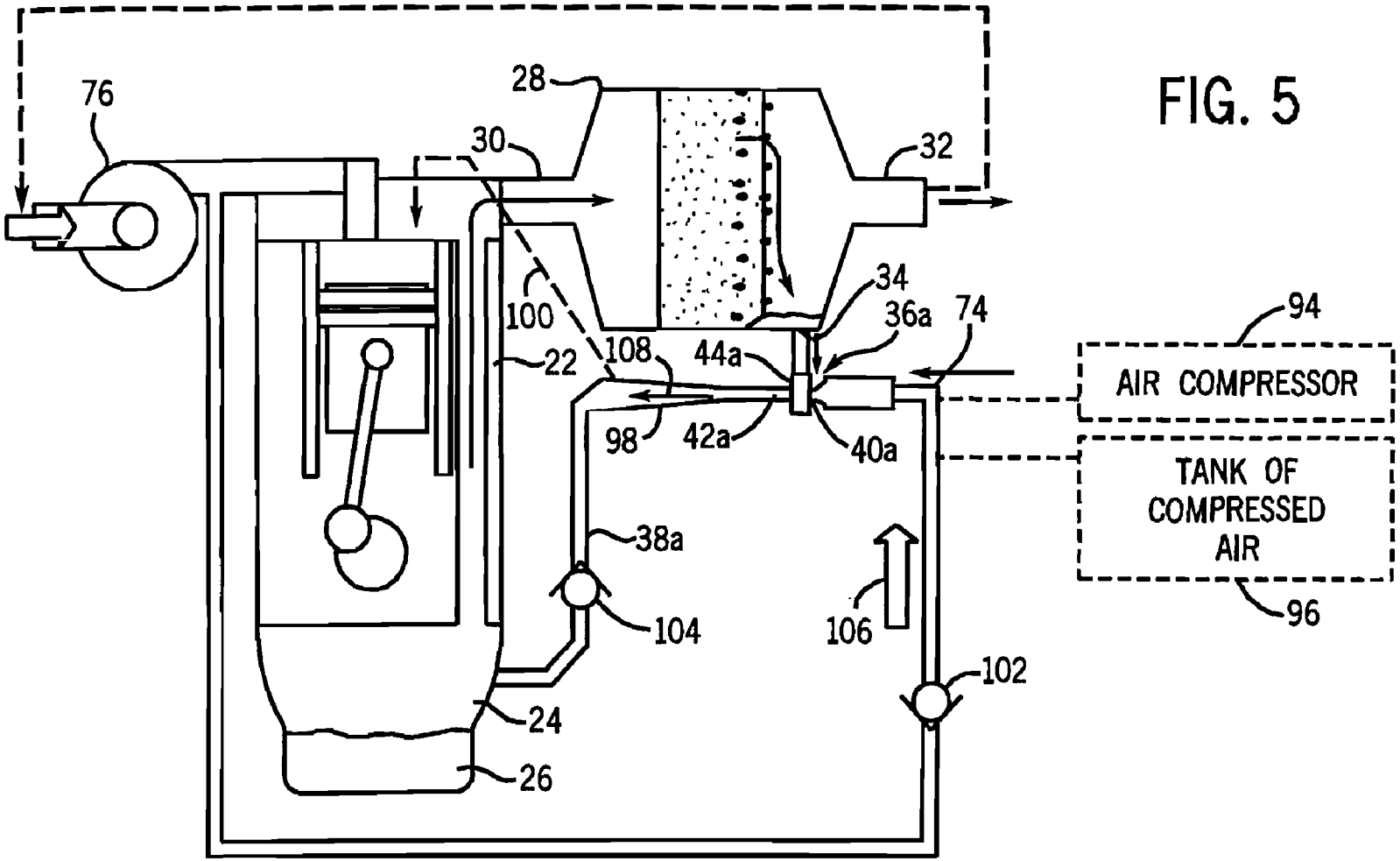

FIG. 5 shows a further embodiment and uses like reference numerals from above where appropriate to facilitate understanding. Jet pump 36*a* is an air-driven jet pump having a pressurized drive input 40*a* receiving pressurized motive air at conduit 74 from a compressed air source, to be described, a suction input at 44*a* receiving separated oil from oil outlet 34 of separator 28, and an output 42*a* delivering jet-pumped oil and motive air via conduit 38*a* to crankcase 24. In the embodiment of FIG. 5, engine 22 has a turbocharger 76 delivering pressurized air for combustion. The noted compressed air source is provided by turbocharger 76, and pressurized drive input 40*a* of jet pump 36*a* receives pressurized motive air from turbocharger 76 via air line 74.

Figure 6:
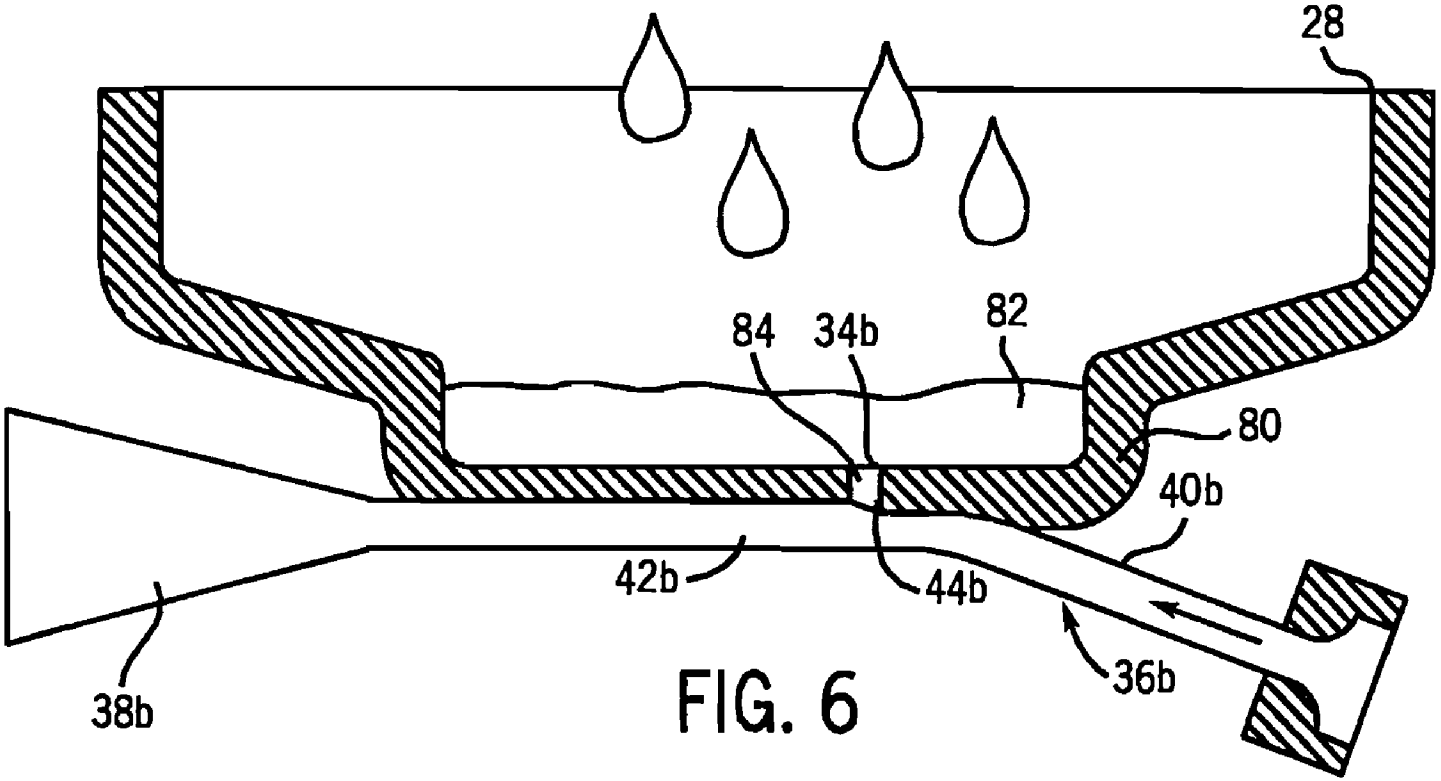

FIG. 6 shows another embodiment and uses like reference numerals from above where appropriate to facilitate understanding. Separator 28 has a lower wall surface 80 providing a collection sump 82 collecting separated oil. Jet pump 36*b* is formed in wall surface 80 and includes a pressurized drive input 40*b* receiving pressurized motive fluid from a source of pressurized fluid, e.g. oil pump 48 or turbocharger 76, a suction input 44*b* receiving separated oil from oil outlet 34*b* provided by a drain passage 84 through wall 80, and an output 42*b* like mixing bore 42*a* and 42 and of greater diameter than drive input 40*b* and delivering jet-pumped oil to the crankcase via conduit 38*b* as above. In various embodiments, the pressurized motive fluid is selected from the group consisting of oil and air, and the source of pressurized fluid is selected from the group consisting of an oil pump, a turbocharger, an air compressor, and a tank of compressed air.

Figure 7:
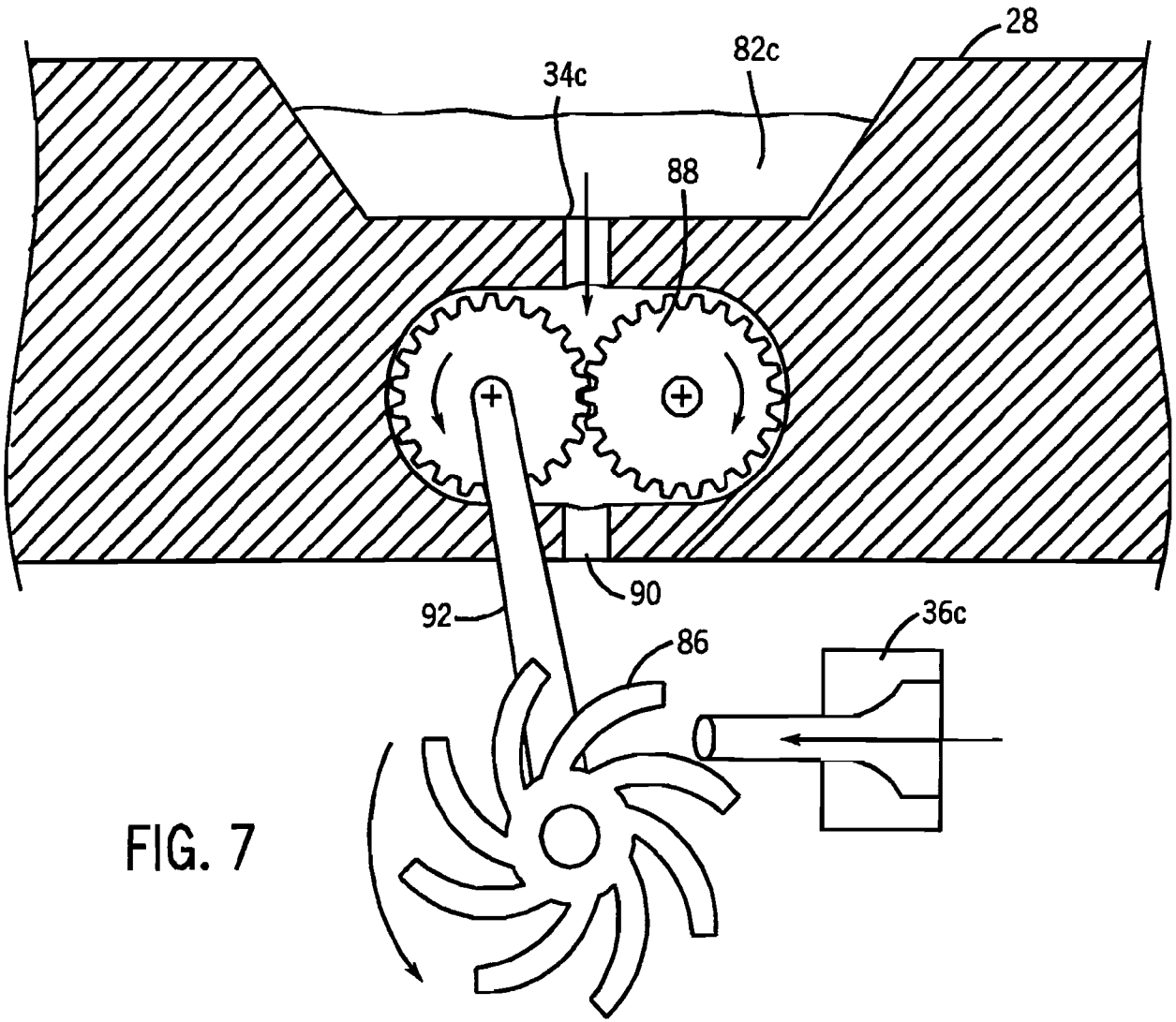

FIG. 7 shows another embodiment and uses like reference numerals from above where appropriate to facilitate understanding. Separator 28 has a lower collection sump at 82*c*. The system includes a turbine 86 driven by jet 36*c*, and a mechanical pump 88 driven by turbine 86 and suctioning oil from oil outlet 34*c* of separator 28 and pumping same at pump outlet 90 to crankcase 24, as above. In one embodiment, with engine 22 having a valvehead closed by a valvehead cover, the turbine is located in such valvehead beneath the valvehead cover. In another embodiment, the turbine is located in the crankcase. Various turbines may be used, including spiral vane turbines, Pelton turbines, Turgo turbines, etc. Various pumps may be used, including simple mechanical pumps, positive displacement gear pumps, etc. Various connections may be used between the turbine and the pump, such as a speed reduction transmission, a rotating shaft, etc.

As above noted, various pressurized motive fluids may be used for the jet pump, including oil, FIGS. 1, 3, 4, and air, FIG. 5. The source of pressurized fluid can be an oil pump, e.g. 48, FIGS. 1, 3, 4, a turbocharger 76, FIG. 5, an air compressor, e.g. as shown in dashed line at 94 in FIG. 5, a tank of compressed air, e.g. as shown in dashed line at 96 in FIG. 5, and other sources. Other variations include multiple jet nozzles 40 feeding a single mixing bore 42. Designs with non-circular motive jet and mixing bore geometries may be used, but are not considered optimal. The use of a diverging diffuser 98, FIG. 1, on the mixing bore exit is desirable but not necessary if maximum pumping efficiency is not needed. In one particular embodiment, jet nozzle 40 has a diameter of 0.3 mm (millimeters), mixing bore 42 has a diameter of 1 mm, the length of mixing bore 42 before it starts to diverge at 98 is 4 mm, and the diameter of suction port 44 is 1 mm, with 40 psi (pounds per square inch) motive pressure oil at 180° F. (Fahrenheit) and a suction liquid source at 34 at 100° F. and a pressure of about minus 15 inches of water (−0.5 psi) relative to the crankcase pressure at 24, with motive flow at about 0.8 mL/s (milliliters per second) and entrained suction flow at about 0.3 mL/s. The predicted "stall suction" (the pressure in suction port 44 at which the jet pump can no longer pull fluid from such suction port) is about 112 inches of water which is well beyond the typical 5 to 15 inches of water needed for such application.

Impactor and coalescer separators have been shown, and other types of aerosol separation devices may be used, including electrostatic separators, cyclones, axial flow vortex tubes, powered centrifugal separators, motor or turbine-driven cone-stack centrifuges, spiral vane centrifuges, rotating coalescers, and other types of separators known for usage in engine blowby aerosol separation.

The scavenged separated oil may be returned directly back to the crankcase at conduit 38, or may be indirectly returned to the crankcase, for example the scavenged separated oil may be returned initially to the valve cover area, as shown in dashed line at 100, FIG. 5, which oil then flows back to the crankcase. Claim limitations regarding a jet pump pumping scavenged separated oil from the oil outlet of the separator to the crankcase may thus include flow path segments through other portions of the engine prior to reaching the crankcase. Furthermore, the term crankcase includes not only the lower region of the engine collecting oil at 26 but also other sections of the engine in communication therewith, including sections at the noted pressure causing the noted backflow tendency, which backflow tendency pressure is overcome by the jet pump.

The motive flow at elevated pressure provided by the jet pump creates a high velocity small diameter jet 40 within a larger diameter mixing bore 42, effectively converting the jet kinetic energy into pumping power, as is known. The motive source 40 and/or the suction source 44 may need screen filter protection to prevent plugging of the very small diameters, e.g. less than 1 mm. For example, it may be desirable to use a filter patch, sintered metal slug, screen, or other filtering to allow liquid and air to flow freely through the device.

In a desirable aspect, many of the illustrated passages may be integrated and contained within engine castings and components, rather than being external lines, which is desirable for reduction of plumbing. The embodiment of FIG. 6 may be desirable to provide a jet impinging on an orifice/groove integrally formed in the sump housing wall to create the desired extraction suction. When using compressed air for the motive fluid, another source may be the engine's air intake manifold, whereby compressed air may be routed from the intake manifold and ducted into the crankcase ventilation system to provide the motive fluid for the jet pump. Molded-in channels may be used to route air from the manifold through the valve cover and into the crankcase ventilation system. Likewise, the scavenged separated oil may be ducted from the jet pump output 42 to the underside of the valve cover, e.g. as shown at 100, for return to the crankcase.

In the preferred embodiment, a jet pump is provided with a mixing bore 42 having a larger diameter than jet 40 in the case of round bores, and a greater cross-sectional area in the case of round or non-round bores or multiple jets 40. In other embodiments, the cross-sectional area of mixing bore 42 may be the same as the cross-sectional area of jet 40, thus providing a jet pump which is a venturi with a smooth transition between jet 40 and mixing bore 42 and no step in diameter therebetween. This type of jet pump venturi relies on Bernoulli's principle to create suction at suction port 44. A jet pump with a larger area mixing bore 42 than jet 40 is preferred because it has higher pumping efficiency and capacity, i.e. it can pull or suction more scavenged oil at port 44 for a given motive flow at jet 40; however, less than optimum pumping efficiency and capacity may be acceptable because only a very small amount of oil need be scavenged and suctioned at port 44 from separator 28. In some instances, a mixing bore 42 having a cross-sectional area slightly less than jet 40 may even be acceptable because of the noted low efficiency and low capacity requirements. Accordingly, the system may use a jet pump having a mixing bore 42 having a cross-sectional area greater than or substantially equal to the cross-sectional area of jet 40. The noted embodiments having the cross-sectional area of mixing bore 42 equal to or slightly less than (substantially equal to) jet 40 provide a venturi or venturi-like jet pump. The preferred jet pump, however, has a mixing bore 42 with a cross-sectional area greater than jet 40 because of the noted higher efficiency and capacity. An area ratio up to about 25:1 (diameter ratio 5:1) may be used in some embodiments, and in other embodiments an area ratio up to about 100:1 (diameter ratio 10:1) may be used, though other area and diameter ratios are possible. The lower limit of a jet pump (cross-sectional area of mixing bore 42 substantially equal to cross-sectional area of jet 40) may thus be used in the parent system, though it is not preferred. Instead, a mixing bore 42 having a greater cross-sectional area than jet 40 is preferred.

In a further embodiment, one or more optional check valves 102 and 104, FIG. 5, are provided in the motive line 74 and/or the drain line 38*a* to prevent backflow in a condition (infrequent) of low or negative air supply pressure, e.g. when a truck is in a long down-hill run, where the turbo is idling. Check valve 102 is a one-way valve providing one-way flow as shown at arrow 106, and blocking reverse flow. Check valve 104 is a one-way valve permitting one-way flow as shown at arrow 108, and blocking reverse flow.

Present Application

FIGS. 8-12 show a crankcase ventilation system 110 and use like reference numerals from above where appropriate to facilitate understanding. The crankcase ventilation system is provided for an internal combustion engine 22, FIG. 1, generating blowby gas in a crankcase 24 containing engine oil 26 and oil aerosol. The system includes an air-oil separator 28, FIGS. 1, 3-5, having an inlet 30 receiving blowby gas and oil aerosol from the crankcase, and having an air outlet discharging clean blowby gas to the atmosphere or returned to the engine air intake, and having an oil outlet 34 and/or 66 discharging scavenged separated oil back to the crankcase. The system includes a pump 112 driven by the engine, to be described, and pumping scavenged separated oil. The pump has an inlet 114 connected to oil outlet 34 and/or 66 of separator 28. The pump has an outlet 116 connected to crankcase 24, e.g. by connection conduit 38, FIG. 1. Each of the inlet and outlet of the pump may have a respective one-way valve 118, 120, e.g. a check valve, providing one-way flow from inlet 114 to outlet 116, and may also have a respective filter 122, 124 filtering oil flow therethrough. Pump 112 is preferably a positive displacement pump, and further preferably a diaphragm pump. Engine 22 generates pulsating oscillatory positive and negative relative pressure pulses, and the noted diaphragm pump is further preferably driven by such pressure pulses, e.g. supplied from the crankcase to the pump, e.g. at port 126.

As noted above, separator 28 has a pressure drop thereacross such that the pressure at inlet 30 and in crankcase 24 is higher than the pressure at air outlet 32 and at oil outlet 34, 66. The pressure differential between crankcase 24 and oil outlet 34, 66 normally tends to cause backflow of oil from the higher pressure crankcase 24 to the lower pressure oil outlet 34, 66. In the prior art, oil outlet 34, 66 is located at a given elevation above crankcase 24 (typically greater than about 15 inches, though the dimensions vary) and a vertical connection tube is provided therebetween with a check valve, such that a gravity head develops and can overcome the noted pressure differential. In contrast, pump 112 supplies pumping pressure greater than the noted pressure differential to overcome the noted backflow tendency and instead cause suctioning of scavenged separated oil from oil outlet 34, 66 and pumping of same to crankcase 24 via connection conduit 38. In the preferred embodiment, pump 112 drains scavenged separated oil from oil outlet 34, 66 without having to rely on gravity head drain, or at least without having to rely solely on gravity head drain.

Pump 112 includes a housing 128 defining a chamber 130 having a diaphragm 132 therein dividing the chamber into first and second subchambers 134 and 136. First subchamber 134 receives variable pressure which flexes diaphragm 132 in back and forth directions (leftwardly and rightwardly in FIG. 8) to expand and contract first subchamber 134 and inversely respectively contract and expand second subchamber 136. Second subchamber 136 has the noted inlet 114 receiving scavenged separated oil from oil outlet 34, 66 of separator 28. Second subchamber 136 has the noted outlet 116 discharging scavenged separated oil to crankcase 24, e.g. via connection conduit 38. One or more check valves 118, 120 provide one-way flow through second subchamber 136 from inlet 114 to outlet 116. In some embodiments, a biasing member 138 may be provided for biasing diaphragm 132 in one of the noted back and forth directions, and opposing movement of the diaphragm in the other of the back and forth directions, for example a compression spring 138 biasing diaphragm 132 leftwardly in FIG. 8 and opposing rightward movement of the diaphragm, and in another example a tension spring at 138 biasing diaphragm 132 rightwardly in FIG. 8 and opposing leftward movement of the diaphragm. In a further embodiment, pump 112 includes an adjustment wall 140 movably adjustable (e.g. left-right in FIG. 8) to vary the volume of second subchamber 136. In one preferred embodiment, first subchamber 134 receives the noted pressure pulses from the engine at port 126 which in turn flex diaphragm 132 in the noted back and forth directions to expand and contract first subchamber 134 and inversely respectively contract and expand second subchamber 136.

FIG. 9 shows a further embodiment and uses like reference numerals from above where appropriate to facilitate understanding. Pump 112 includes a magnet 142 and/or 144 applying magnetic force aiding the noted pumping of scavenged separated oil from oil outlet 34, 66 of separator 28 to crankcase 24. First subchamber 134 receives variable pressure at port 126*a*, which may be the noted engine pressure pulses, which flexes diaphragm 132 in the noted back and forth directions. One or more magnets 142, 144 apply at least one of magnetic attraction and magnetic repulsion force to aid flexing of the diaphragm in at least one of the noted back and forth directions. In one embodiment, magnet 142 is located on diaphragm 132 and moves therewith during flexing thereof in the noted back and forth directions. Housing 128 at end wall 146 may be magnetically permeable metallic material to provide magnetic coupling for the noted magnetic force. Magnet 142 is thus in first chamber 134. In another embodiment, magnet 144 is located on housing wall 146 at first subchamber 134, which housing wall 146 may then be magnetic or nonmagnetic, which housing wall 146 defines chamber 130 including first subchamber 134. Magnet 144 may be external or internal to first subchamber 134. In the embodiment with magnet 144 on housing wall 146, the other magnet 142 may be eliminated, and a portion of diaphragm 132 may be provided by magnetically permeable material, or a magnetically permeable metallic plate may be provided thereon, to provide magnet coupling to magnet 144 to provide the noted magnetic force. Variation embodiments thus include versions without magnet 144, and other versions without magnet 142. In yet further embodiments, both of the noted first and second magnets 142 and 144 are provided, with first magnet 142 being located on diaphragm 132 and moving therewith during flexing thereof in the noted back and forth directions, with first magnet 142 preferably being in first subchamber 134, and with second magnet 144 magnetically coupling with first magnet 142. In one embodiment, first and second magnets 142 and 144 have like polarity poles facing each other to magnetically repulse one another, e.g. respective south polarity poles 148 and 150 of magnets 142 and 144 facing each other. In this embodiment, the respective north polarity poles 152 and 154 of magnets 142 and 144 face distally oppositely. In the embodiment of FIG. 9, first and second magnets 142 and 144 are spaced by first subchamber 134 and housing wall 146 therebetween.

FIG. 10 shows another embodiment and uses like reference numerals from above where appropriate to facilitate understanding. In contrast to FIG. 9 where magnet 144 is stationary, magnet 144*a* in FIG. 10 is a dynamic magnet movable toward and away from diaphragm 132 to dynamically vary magnetic force thereon, whether or not magnet 142 is used. In one embodiment, dynamic magnet 144*a* is driven by a rotary engine component 156, e.g. an idler pulley on the engine camshaft 158, to thus dynamically move magnet 144*a* closer to and farther away from diaphragm 132 in an oscillatory manner, by rotation of shaft 158 and pulley 156.

FIG. 11 shows a further embodiment and uses like reference numerals from above where appropriate to facilitate understanding. Dynamic magnet 144*a* may be oscillated back and forth in a translational oscillatory manner by movement of a solenoid plunger 160 in a solenoid 162 and linkage from an engine rocker arm or the like. Other oscillatory movement of dynamic magnet 144 may be used, for example linkage from an engine rocker arm or the like, and in another example using the noted engine pressure pulses in a pumping manner to oscillate dynamic magnet 144*a* back and forth. The movement of dynamic magnet 144*a* back and forth toward and away from diaphragm 132 dynamically varies magnetic force thereon.

FIG. 12 shows a further embodiment and uses like reference numerals from above where appropriate to facilitate understanding. A variable pressure supply 164 supplies variable pressure to first subchamber 134 to flex diaphragm 132 in the noted back and forth directions. The variable pressure is preferably obtained from the noted engine pressure pulses, though other variable pressure sources may be used for example the engine intake, turbocharger, oil pressure, other crankcase pressure, or other variable pressure source. In one embodiment, the variable pressure source 164 is a bellows having a forcing function input or actuator provided by oscillation (force=mass×acceleration), a solenoid, magnetic, pulsating pressure, or other force.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

What is claimed is:

1. A crankcase ventilation system for an internal combustion engine generating blowby gas in a crankcase containing engine oil and oil aerosol, said system comprising an air-oil separator having an inlet receiving said blowby gas and oil aerosol from said crankcase, an air outlet discharging clean blowby gas, and an oil outlet discharging scavenged separated oil, and a pump driven by said engine and pumping said scavenged separated oil from said oil outlet of said separator to said crankcase wherein said pump comprises a chamber having a diaphragm therein dividing said chamber into first and second subchambers, said first subchamber receiving variable pressure which flexes said diaphragm in back and forth directions to expand and contract said first subchamber and inversely respectively contract and expand said second subchamber, said second subchamber having an inlet receiving scavenged separated oil from said oil outlet of said separator, said second subchamber having an outlet discharging said scavenged separated oil to said crankcase.

2. The crankcase ventilation system according to claim 1 comprising one or more check valves providing one-way flow through said second subchamber from said inlet of said second subchamber to said outlet of said second subchamber.

3. The crankcase ventilation system according to claim 1 comprising a biasing member biasing said diaphragm in one of said back and forth directions, and opposing movement of said diaphragm in the other of said back and forth directions.

4. The crankcase ventilation system according to claim 1 wherein said pump comprises an adjustment wall movably adjustable to vary the volume of said second subchamber.

5. The crankcase ventilation system according to claim 1 wherein said engine generates pulsating oscillatory positive and negative relative pressure pulses, said variable pressure being supplied by said pressure pulses, said first chamber receiving said pressure pulses which in turn flex said diaphragm in said back and forth directions to expand and contract said first subchamber and inversely respectively contract and expand said second subchamber.

* * * * *